US006592101B2

(12) United States Patent
Vetesnik

(10) Patent No.: US 6,592,101 B2
(45) Date of Patent: Jul. 15, 2003

(54) HOIST WITH SHOCK ABSORBING DEVICE FOR THE LOAD

(75) Inventor: Jan Vetesnik, Winnipeg (CA)

(73) Assignee: Unique Concepts Ltd., Winnipeg (CA)

( * ) Notice: Subject to any disclaimer, the term of this patent is extended or adjusted under 35 U.S.C. 154(b) by 0 days.

(21) Appl. No.: 09/976,267

(22) Filed: Oct. 15, 2001

(65) Prior Publication Data

US 2002/0070376 A1 Jun. 13, 2002

(51) Int. Cl.[7] ..... B66D 1/36
(52) U.S. Cl. ..... 254/285; 254/284; 254/415
(58) Field of Search ..... 254/285, 284, 254/286, 415; 212/166; 182/70, 73, 75, 193, 195, 191, 192; 188/65.2–65.4

(56) References Cited

U.S. PATENT DOCUMENTS

| | | | | | |
|---|---|---|---|---|---|
| 4,109,798 A | * | 8/1978 | Comyns-Carr | ..... | 212/238 |
| 4,135,627 A | * | 1/1979 | McInerney | ..... | 212/299 |
| 4,471,877 A | * | 9/1984 | Whitly | ..... | 212/273 |
| 4,574,964 A | * | 3/1986 | Berger | ..... | 212/276 |
| 4,787,524 A | * | 11/1988 | Cobb et al. | ..... | 212/278 |

* cited by examiner

*Primary Examiner*—Kathy Matecki
*Assistant Examiner*—Evan H Langdon

(74) *Attorney, Agent, or Firm*—Adrian D. Battison; Michael R. Williams; Ryan W. Dupuis

(57) ABSTRACT

A shock absorbing device is provided for use on a hoist of the type generally used for safety of personnel entering a manhole or the like which has a base for mounting on a support surface at the hole and a jib portion. A winch is mounted at one position on the hoist for paying out and pulling in a first cable which passes over the jib portion to a pulley at the jib end. A fall restraint device with a second cable is mounted at a different location on the host with the second cable extending upwardly from the hoist to a second pulley at the jib end. The shock absorbing device for the pulleys includes a common mounting member pivotally attached to the mounting element at the jib end for pivotal movement relative thereto about a horizontal axis with a shock absorbing brake arranged to resist said pivotal movement up to a predetermined load limit such that a downward shock force from the load on at least one of the first and second pulleys causes the common member to pivot downwardly in a shock absorbing action. The first and second pulleys are arranged on the mounting element such that the distance of the vertical run of the first pulley from the horizontal axis is different from the distance of the vertical run of the second pulley from the horizontal axis by an amount, for example 2:1, which tends to equalise the shock forces required for and/or the distance move by the two cables bearing in mind the difference in mechanical advantage over the pulleys caused by the difference in angle of the two cables.

17 Claims, 2 Drawing Sheets

FIG. 2
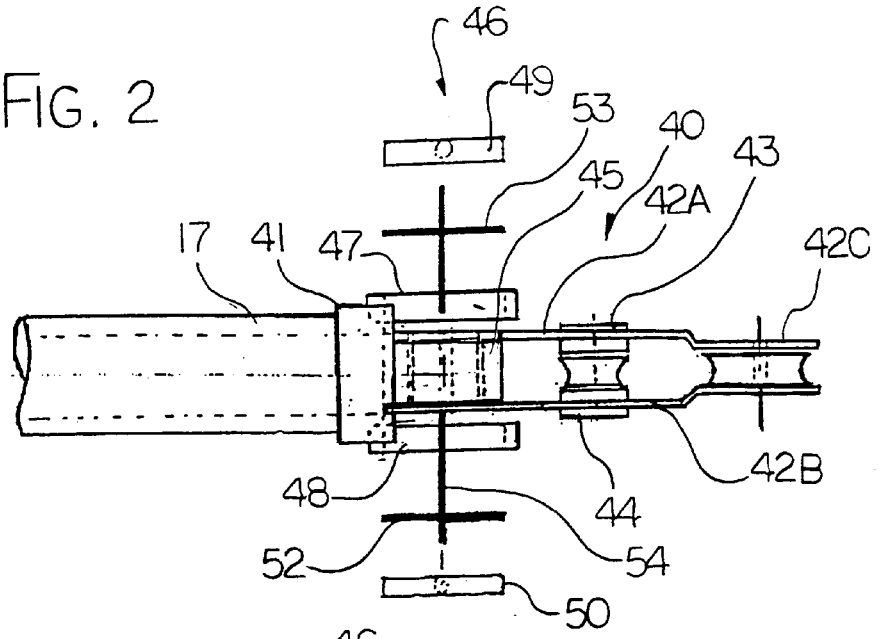
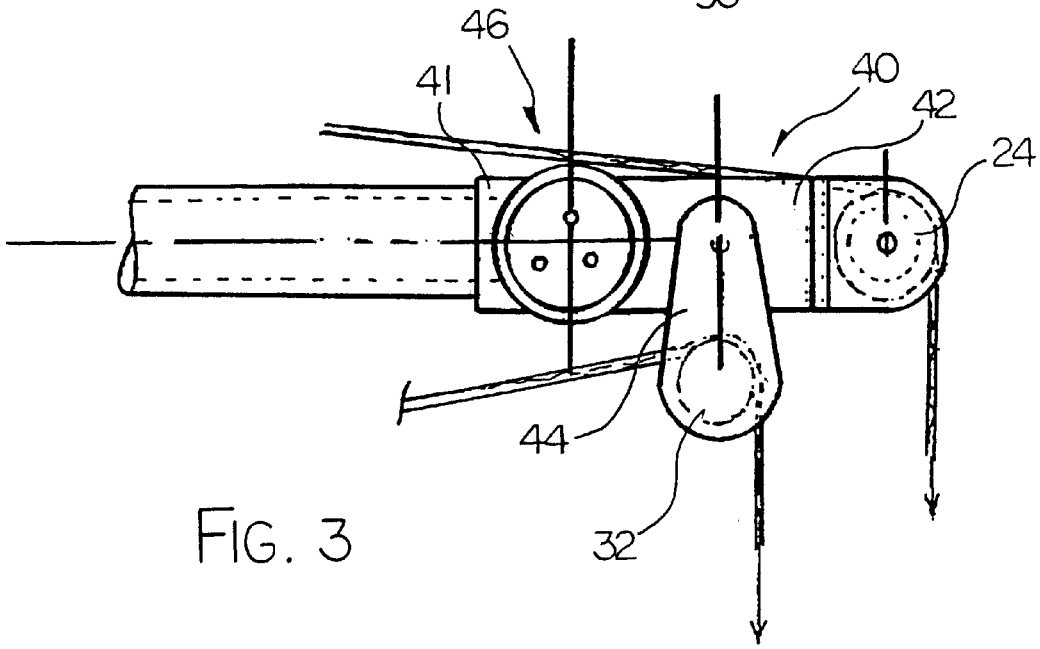
FIG. 3

HOIST WITH SHOCK ABSORBING DEVICE FOR THE LOAD

The present invention to relates a hoist including a shock absorbing device for the load and to a shock absorbing device for use with a hoist.

BACKGROUND OF THE INVENTION

Many different designs of hoist are available for mounting in different locations and including different features for different end uses. The present invention is primarily but not exclusively concerned with safety systems by which an operator can enter through a manhole into a tank or pipe for investigation or service. Current regulations require that the operator be attached to a hoist so that in the event any injury or incapacitation, the operator can be returned to the surface by operation of the hoist.

A number of different designs of hoist of this type have been proposed where a base is located on the ground with legs surrounding the entrance hole and a jib portion extending from the base to an upper end where there is provided a cable guide which allows the cable to extend downwardly between the legs into the entrance so that the cable can pass into they underground area through the hole without dragging on the side of the hole. A manually operable winch is conventionally located on the jib portion so that it can be operated to winch the person back to the surface as required.

SUMMARY OF THE INVENTION

In view of the foregoing, it is an object of the present invention to provide an improved hoist which includes a single shock absorbing device which operates to provide effective shock absorbing characteristics for two cables.

According to a first aspect of the invention there is provided a hoist comprising:

a base for mounting on a support surface;

a jib portion mounted on the base and extending therefrom to a jib end arranged to be located over a load to be supported;

a first cable pay-out device having a first cable, the first cable pay-out device being mounted on the hoist for paying out and pulling in the first cable;

a second cable pay-out device having a second cable, the second cable pay-out device being mounted on the hoist for paying out and pulling in the second cable;

a first pulley at the jib end for the first cable arranged such that the first cable passes over the first pulley from the first cable pay out device and provides a vertical run of the first cable from the first pulley vertically downwardly to the load which applies a downward force from the load on the first pulley;

a second pulley at the jib end for the second cable arranged such that the second cable passes over the second pulley from the second cable pay out device and provides a vertical run of the first cable from the second pulley vertically downwardly to the load which applies a downward force from the load on the second pulley;

the first cable pay out device being located on the hoist at a first location so that a run of the cable from the first cable pay out device to the first pulley extends at a first angle relative to the vertical run of the first cable;

the second cable pay out device being located on the hoist at a second location different from the first location so that a run of the cable from the second cable pay out device to the second pulley extends at a second angle relative to the vertical run of the second cable which is different from the first angle;

and a shock absorbing device for the pulleys comprising:

a common member arranged for attachment to the jib end with both the first and second pulleys being mounted on the common member at the jib end;

the common member being mounted at the jib end for pivotal movement relative to the jib end about a horizontal axis spaced from the vertical runs of the first and second cables;

the common member including a shock absorbing brake arranged to resist said pivotal movement up to a predetermined load limit such that a downward shock force from the load on at least one of the first and second pulleys causes the common member to pivot downwardly in a shock absorbing action;

the first and second pulleys being arranged such that the distance of the vertical run of the first pulley from the horizontal axis is different from the distance of the vertical run of the second pulley from the horizontal axis.

It is of course an intended or desirable object of the features set forth above that the difference in distance from the axis is related to the difference in the angle so as to tend to equalise the shock force required for and/or the distance moved by the first and second cables. Thus the difference in distance from the axis is generally dependent upon or proportional to a difference in mechanical advantage of the first and second cables generated by the difference in the angle.

The base can be of any construction including but not limited to an element having legs for resting on the surface, a frame for bolted attachment to the surface or a permanently mounted element fastened to the surface.

Preferably the first and second pulleys are mounted with their respective axes of rotation at different distances from the horizontal axis so that the pulleys may be of the same or similar size.

Preferably the common mounting member comprises an arm with the horizontal axis at one end, the first pulley at the other end and the second pulley intermediate the ends and the second pulley is mounted on the arm so as to depend below the arm.

In a preferred arrangement the first pulley is arranged such that the run of the first cable passes over the jib end to the first pulley and the second pulley is arranged such that the run of the second cable passes from below the jib end to the first pulley.

In this preferred arrangement, the first cable pay out device is located on a side of the jib portion away from the jib end and comprises a winch operable to lift the load and wherein the second cable pay out device is located on a side of the jib port facing the jib end and comprises a fall restrain device.

In this preferred arrangement where the second cable extends from below the difference in mechanical advantage is approximately 2:1 so that the difference in distance is also approximately 2:1.

The above term "shock absorbing brake" is not intended to limit this invention to any particular form of component which restricts the pivotal movement of the common member. While in a preferred arrangement, this may include clamped brake disks, other restriction devices can be used including frangible couplings and springs.

The use of the term "cable" herein is not intended to limit the invention to any particular construction or material and any elongate element suitable for use in lifting or securing a load can be used including rope, chain and the like.

According to a second aspect of the invention is provided the shock absorbing device per se which is defined above and is arranged for use with a hoist of this general type in which two cables are provided at different angles. Thus the present invention includes the aspect of a shock absorbing device sold as a separate element for attachment to an existing hoist. Such an arrangement can include a mounting collar or insert which is designed to engage into or onto an existing jib end and generally but not always this will include a stub shaft which is inserted into an end of the tube forming the jib portion.

BRIEF DESCRIPTION OF THE DRAWINGS

On embodiment of the invention will now be described in conjunction with the accompanying drawings in which:

FIG. 2 is a side elevational view on an enlarged scale of the hoist of FIG. 1 showing the shock absorbing mechanism.

FIG. 3 is a top plan view of the shock absorbing mechanism of FIG. 2.

DETAILED DESCRIPTION

Figure 1:
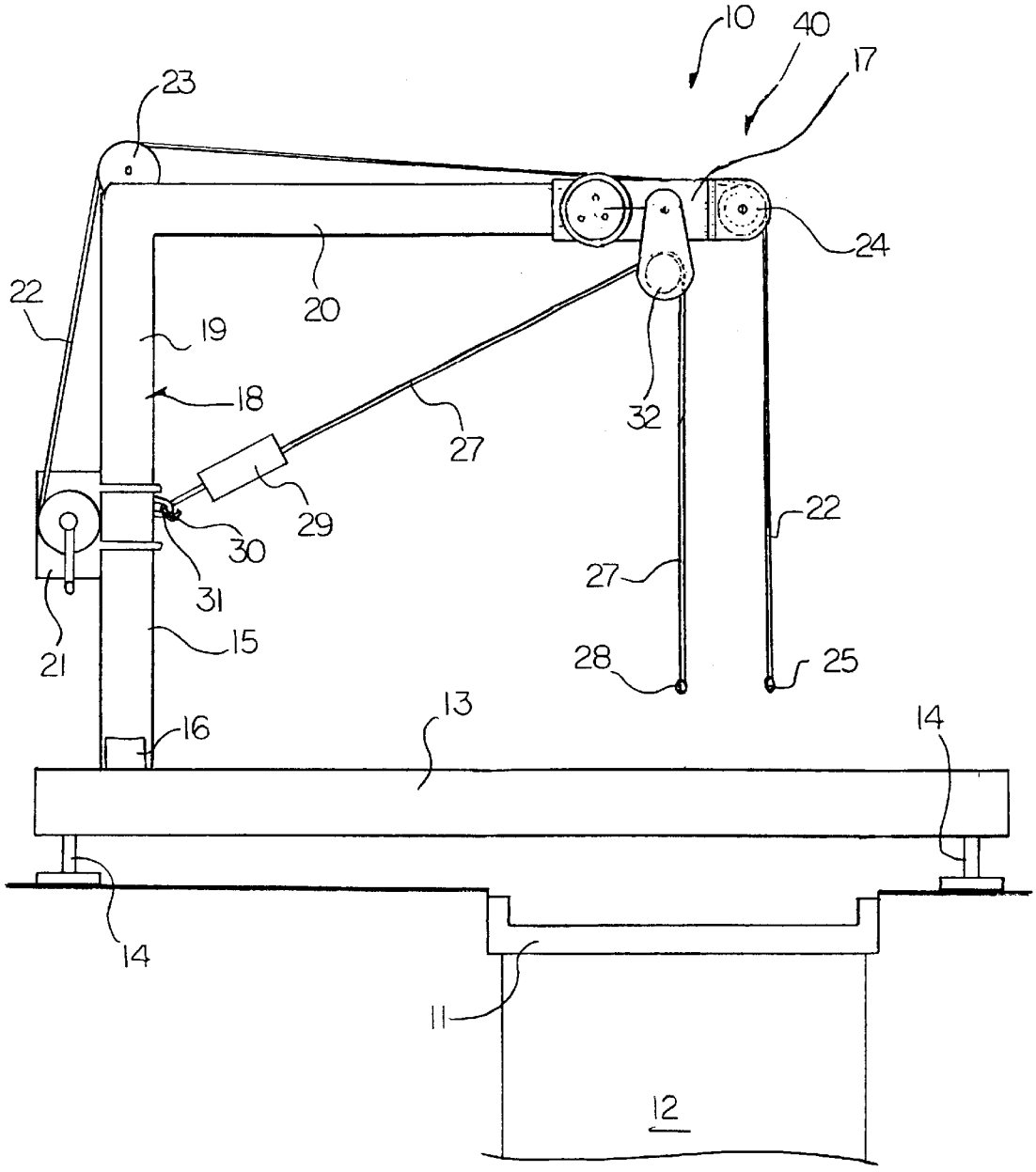
FIG. 1 is side elevational view of a hoist according to the present invention.

A hoist 10 is generally indicated in FIG. 1 and is arranged as one example for use with a manhole 11 providing entry into an underground area 12. The hoist 10 includes a base 13 having suitable support legs 14 by which the base can be located at or around the manhole allowing access to the manhole for a person to enter. The base carries a jib portion 15 which in many cases can be separated for ready transportation and can in some cases swivel about a mounting point 16 allowing a jib end 17 to be moved to a position over the manhole. The jib end 17 forms part of a jib 18 which in the example shown includes a post 19 and a horizontal section 20. The construction arrangement of the base and jib portion can vary widely depending upon engineering requirements and is certainly not necessary that the construction include a vertical post and a horizontal section since these may be angled or curved.

One example of a hoist of this type is shown in U.S. patent application Ser. No. 09/882,266 filed Jun. 18, 2001, the subject matter of which is incorporated herein by reference.

The hoist further includes a winch 21 which is often clamped to the jib portion and provides a cable 22 which can be reeled in and paid out over a top pulley 23 to a first pulley 24 of the first cable 22 at the jib end. This cable therefore provides a main winch cable which allows a load on a connection point 25 of the cable to be raised and lowered while providing a downward force on the cable which is applied over the pulleys 24 and 23 to the winch 21. The winch 21 and the pulley 24 thus define a first cable pay-out device.

A second cable 27 includes a second connection point 28 which can be also attached to the load, which in this case is primarily intended to be the person entering the manhole although of course the winch can be used for other purposes. The cable 27 forms part of a fall restraint system 29 of a type which is readily commercially available and allows the cable 27 to be paid out as it is pulled until the pay-out speed exceeds a predetermined speed whereupon the pay-out is ceased to lock the cable against further movement. The fall restraint device 29 is generally a separate unit which provides a suitable connection point 30 which is attached to the winch at a suitable location or bracket 31 thereon. The fall restraint device 29 thus provides a second cable pay-out device.

The cable 27 passes over a second pulley 32 at the jib end and the deep ends in a vertical portion thereof adjacent to and alongside the cable 22.

In order to provide a shock absorber for both of the cables simultaneously, a shock absorber device generally indicated at 40 is provided which is shown in more detail in FIGS. 2 and 3. The shock absorber device 40 includes a mounting element 41 which attaches to the end 17 of the jib portion. The mounting element 41 can be formed as an integral element with the job portion in the event that the shock absorber is sold integral with the hoist or in an alternative arrangement the shock absorber can be supplied with separate element for attachment to an existing hoist in which case the mounting element 41 will be of a construction such as a sleeve which can be readily attached to the end 17 of the jib of the existing hoist.

The mounting element 41 pivotally supports a common mounting element 42 for the pulleys 24 and 32. In the embodiment shown, the mounting member is an arm formed by two side by side straps 42A and 42B which extend outwardly from an inner end at the mounting element 41 to an outer end defining a bearing portion 42C for the pulley 24. At an intermediate position along the straps 42A and 42B is provided a pair of depending plates 43 and 44 which define a bearing section below the arm 42 for the pulley 32. The plates are fixed to the straps so as to hold the pulley 32 in fixed position relative to the arm and therefore in fixed position relative to the pulley 24.

The inner ends of the straps 42 and 42A are attached to a collar 45 which forms one part of a brake assembly 46. The brake assembly further includes a pair of mounting brackets 47 and 48 rigidly attached to the mounting element 41 at the collar 45. The brackets 47 and 48 support outer brake discs 49 and 50 which are held in the brackets and which are clamped against the ends of the sleeve 45 with intervening brake pads 52 and 53. Thus it will be appreciated that the brake assembly 46 allows rotational movement of the arm 42 about an axis 54 which is horizontal, parallel to the axes of the pulleys 32 and 24 and is located at the jib end. The brake assembly, depending upon the adjustable clamping force provided by suitable clamping screws allows the arm 42 to pivot downwardly in the event of a force pulling downwardly on one of the pulleys beyond a predetermined shock force. Once the shock force is exceeded, the brake will release allowing the arm to pivot downwardly. As the downward movement occurs, the cables are also moved downwardly thus providing a shock absorbing action on the cables. The amount of movement available is to a position in which the arm moves approximately 90° but in practice this amount of movement will not occur since the lever arm effect provided by the arm 42 as it moves downwardly from its initial horizontal position to a position closer to vertical reduces so that the shock forces as they decrease and as the mechanical advantage of the lever arm decreases decline to a force less than the pre-set force of the brake thus halting the brake.

However it is important that the cables during this time move over a distance which is approximately equal so as to apply the loads equally to both cables. It is also desirable that the initial shock load which will trigger the breaking action is approximately equal for both of the cables. However in view of the different angles of the cable where the first cable passes in its first run horizontally to the pulley and then vertically downwardly and the second cable extends upwardly as shown in FIG. 1 at an angle of the order of 45° and then downwardly provides a different mechanical advantage over the pulleys. It will be appreciated that where the first run of the cable is horizontal as in the cable 22 downward movement of the pulley provides an equal downward movement of the cable. However, in the situation where a cable extends with its first run approximately vertical, then downward movement of its associated pulley by a certain distance will cause the amount of movement of the cable to be doubled or twice the certain distance.

The same mechanical advantage difference of course affects also the shock loads involved.

In order to equalize these effects, therefore, the distance of the pulley 24 from the pivot axis 54 is approximately double the distance of the pulley 32 from the axis 54.

In the embodiment shown the pulleys are roughly of the same diameter and therefore these distances are calculated initially at the pulley axis. However the pulleys do not need to be of the same diameter and the actual point of relevance is the distance from the axis 54 to the tangent of the cable with its respective pulley where the force is applied.

While the distances shown are approximately 2:1, it will be appreciated that the effect involved does not need to be accurately calculated since it is intended merely to provide cables which move generally over approximately the same distance so as to avoid high stresses caused by differential movement. The arrangement is therefore set up to provide the tendency to equalize these forces rather than an exact accurate calculation which would necessarily in all circumstances equalize those distances and forces.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

What is claimed is:

1. A hoist comprising:

a base for mounting on a support surface;

a jib portion mounted on the base and extending therefrom to a jib end arranged to be located over a load to be supported;

a first cable pay-out device having a first cable, the first cable pay-out device being mounted on the hoist for paying out and pulling in the first cable;

a second cable pay-out device having a second cable, the second cable pay-out device being mounted on the hoist for paying out and pulling in the second cable;

a first pulley at the jib end for the first cable arranged such that the first cable passes over the first pulley from the first cable pay-out device and provides a vertical run of the first cable from the first pulley vertically downwardly to the load which applies a downward force from a load on the first pulley;

a second pulley at the jib end for the second cable arranged such that the second cable passes over the second pulley from the second cable pay-out device and provides a vertical run of the second cable from the second pulley vertically downwardly to the load which applies a downward force from a load on the second pulley;

the first cable pay out device being located on the hoist at a first location so that the first cable defines a first run of the first cable which extends from the first pulley toward the first cable pay out device at a first angle relative to the vertical run of the first cable;

the second cable pay out device being located on the hoist at a second location different from the first location so that the second cable defines a second run of the second cable which extends from the second pulley toward the second cable pay out device at a second angle relative to the vertical run of the second cable which is different from the first angle;

and a shock absorbing device for the pulleys comprising:

a common member arranged for attachment to the jib end with both the first and second pulleys being mounted on the common member at the jib end;

the common member being mounted at the jib end for pivotal movement relative to the jib end about a horizontal axis spaced from the vertical runs of the first and second cables;

the common member including a shock absorbing brake arranged to resist said pivotal movement up to a predetermined load limit such that a downward shock force from the load on at least one of the first and second pulleys causes the common member to pivot downwardly in a shock absorbing action;

the first and second pulleys being arranged such that the distance of the vertical run of the first cable from the horizontal axis is different from the distance of the vertical run of the second cable from the horizontal axis.

2. The hoist according to claim 1 wherein the difference in distance of the vertical run of the first cable from the horizontal axis relative to the distance of the vertical run of the second cable from the horizontal axis is arranged such that distances moved by the first and second cables, caused by the downward pivotal movement of the common member to in the shock absorbing action, are substantially equal.

3. The hoist according to claim 1 wherein the difference in distance of the vertical run of the first cable from the horizontal axis relative to the distance of the vertical run of the second cable from the horizontal axis is substantially proportional to a difference in mechanical advantage of the first and second cables generated by the difference in the angle.

4. The hoist according to claim 1 wherein the first and second pulleys are mounted with their respective axes of rotation at different distances from the horizontal axis.

5. The hoist according to claim 1 wherein the common mounting member comprises an arm with the horizontal axis at one end, the first pulley at the other end and the second pulley intermediate the ends.

6. The hoist according to claim 5 wherein the second pulley is mounted on the arm so as to depend below the arm.

7. The hoist according to claim 1 wherein the first pulley is arranged such that the first run of the first cable passes over the jib end to the first pulley and the second pulley is arranged such that the second run of the second cable passes from below the jib end to the first pulley.

8. The hoist according to claim 7 wherein the first cable pay-out device is located on a side of the jib portion away from the jib end and comprises a winch operable to lift the load and wherein the second cable pay-out device is located on a side of the jib port facing the jib end and comprises a fall restrain device.

9. The hoist according to claim 1 wherein a ratio of the distance of the vertical run of the first cable from the horizontal axis relative to the distance of the vertical run of the second cable from the horizontal axis is substantially 2:1.

10. The hoist according to claim 1 wherein shock absorbing brake includes clamped brake disks.

11. A shock absorbing device for use on a hoist having a base for mounting on a support surface and a jib portion mounted on the base and extending therefrom to a jib end arranged to be located over a load to be supported, a first cable pay-out device having a first cable, the first cable pay-out device being mounted on the hoist for paying out and pulling in the first cable; and a second cable pay-out device having a second cable, the second cable pay-out device being mounted on the hoist for paying out and pulling in the second cable;

the shock absorbing device for the first cable and the second cable comprising:

a mounting element for attachment to the jib end;

a common mounting member pivotally attached to the mounting element for pivotal movement relative thereto about a horizontal axis;

a first pulley on the common mounting member for the first cable arranged such that the first cable passes over the first pulley from the first cable pay-out device and provides a vertical run of the first cable from the first pulley vertically downwardly to the load which applies a downward force from the load on the first pulley;

a second pulley on the common mounting member for the second cable arranged such that the second cable passes over the second pulley from the second cable pay-out device and provides a vertical run of the first cable from the second pulley vertically downwardly to the load which applies a downward force from the load on the second pulley;

the common member being arranged such that the horizontal axis is spaced from the vertical runs of the first and second cables;

the common member including a shock absorbing brake arranged to resist said pivotal movement up to a predetermined load limit such that a downward shock force from the load on at least one of the first and second pulleys causes the common member to pivot downwardly in a shock absorbing action;

the first and second pulleys being arranged on the mounting element such that the distance of the vertical run of the first cable from the horizontal axis is different from the distance of the vertical run of the second cable from the horizontal axis.

12. The shock absorbing device according to claim 11 wherein the difference in distance of the vertical run of the first cable from the horizontal axis relative to the distance of the vertical run of the second cable from the axis is proportional to a difference in mechanical advantage of the first and second cables generated by a difference in angle of the cable over the pulley.

13. The shock absorbing device according to claim 11 wherein the first and second pulleys are mounted with their respective axes of rotation at different distances from the horizontal axis.

14. The shock absorbing device according to claim 11 wherein the common mounting member comprises an arm with the horizontal axis at one end, the first pulley at the other end and the second pulley intermediate the ends.

15. The shock absorbing device according to claim 14 wherein the second pulley is mounted on the arm so as to depend below the arm.

16. The shock absorbing device according to claim 11 a ratio of the distance of the vertical run of the first cable from the horizontal axis relative to the distance of the vertical run of the second cable from the horizontal axis is substantially 2:1.

17. The hoist according to claim 11 wherein shock absorbing brake includes clamped brake disks.

* * * * *

UNITED STATES PATENT AND TRADEMARK OFFICE

CERTIFICATE OF CORRECTION

PATENT NO. : 6,592,101 B2
APPLICATION NO. : 09/976267
DATED : July 15, 2003
INVENTOR(S) : Vetesnik It is certified that error appears in the above-identified patent and that said Letters Patent is hereby corrected as shown below:

Title page, please insert the following:

--Item (30) Foreign Application Priority Data

Oct. 13, 2000 (CA) ..... 2,322,132--

Signed and Sealed this

Fifteenth Day of January, 2008

JON W. DUDAS
*Director of the United States Patent and Trademark Office*